11/5/85 XR 4,550,667

United States Patent [19]

Meyers

[11] Patent Number: 4,550,667

[45] Date of Patent: Nov. 5, 1985

[54] SAFE HAVING CONCEALED HINGES

[76] Inventor: Grahame A. Meyers, 29 Rondelay Dr., Castle Hill, N.S.W. 2154, Australia

[21] Appl. No.: 516,895

[22] Filed: Jul. 25, 1983

[30] Foreign Application Priority Data

Jul. 28, 1982 [AU] Australia ..... PF5090

[51] Int. Cl.[4] ..... E05D 7/14; E05G 1/00

[52] U.S. Cl. ..... 109/70; 109/54; 109/85

[58] Field of Search ..... 109/68, 70, 69, 73, 109/74, 80, 83, 85, 58.5-62; 220/331, 345, 346

[56] References Cited

U.S. PATENT DOCUMENTS

| | | | |
|---|---|---|---|
| 9,350 | 9/1852 | Yale | 109/85 |
| 524,941 | 8/1894 | Gochler | 109/85 |
| 957,183 | 5/1910 | Blechschmidt | 109/70 |
| 2,895,761 | 7/1959 | Kroll | 109/59 |
| 3,895,162 | 7/1975 | Lemont et al. | 109/83 |
| 3,899,983 | 8/1975 | Hernandez | 109/54 |

FOREIGN PATENT DOCUMENTS

| | | | |
|---|---|---|---|
| 541191 | 9/1957 | Italy | 109/64 |
| 6415073 | 10/1964 | Netherlands | 109/54 |

*Primary Examiner*—Gene Mancene
*Assistant Examiner*—John G. Weiss
*Attorney, Agent, or Firm*—Stevens, Davis, Miller & Mosher

[57] ABSTRACT

A safe having a body suitable for mounting in a building wall and having a door with concealed hinges. A pair of slide bars are pivotally mounted on the inner face of the door and are slideably received in slide channel blocks on the inside of the safe. When opening, the door is first moved perpendicularly outwardly from the body and then pivoted. When closed the door is securely held by a plurality of registering pins projecting perpendicularly from the inner face of the door and received in tubes on the inside of the body.

4 Claims, 2 Drawing Figures

~FIG. 1~

SAFE HAVING CONCEALED HINGES

Figure 1:
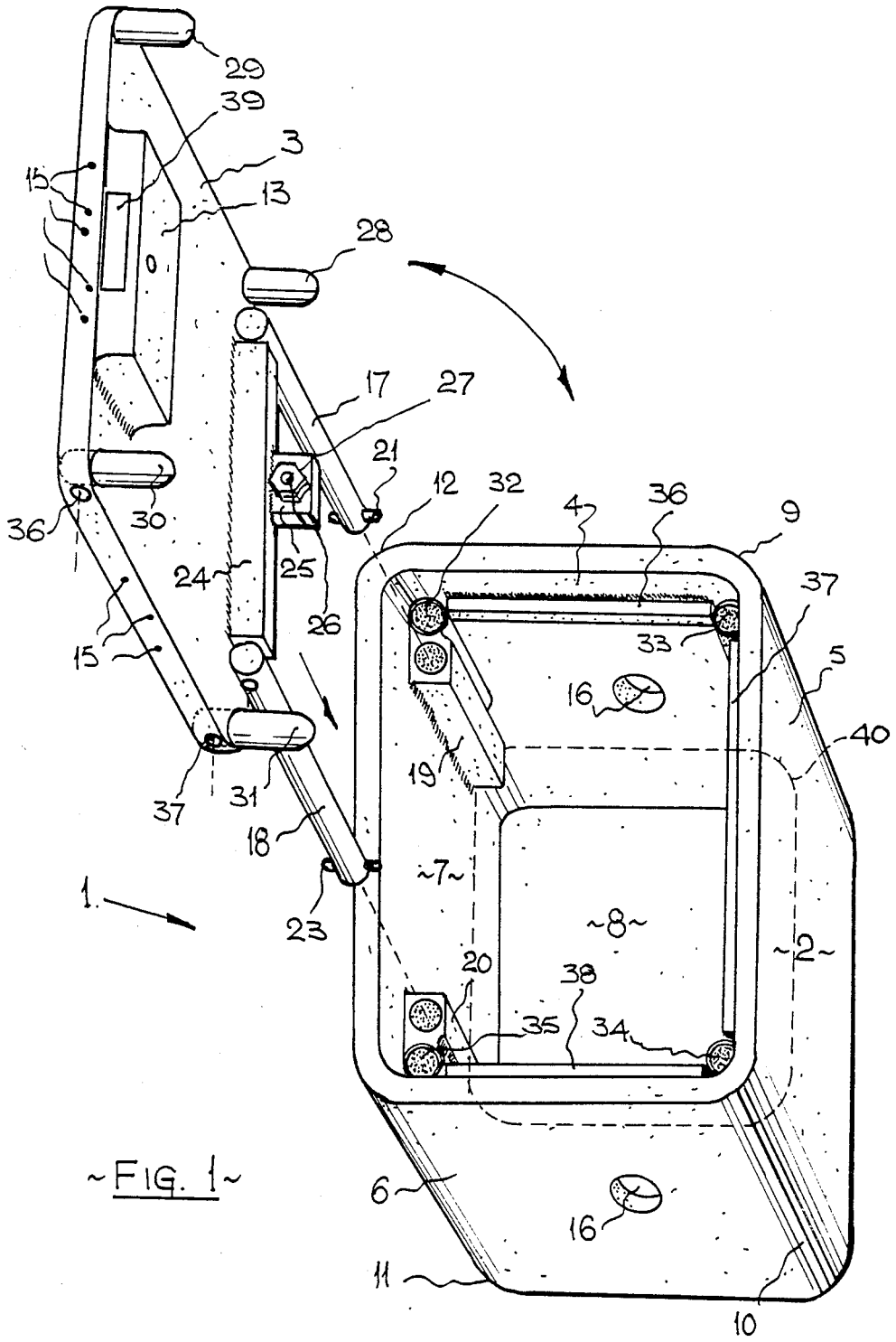

This invention relates to safes, and more particularly to an improved construction of small safes intended primarily for personal, domestic and 'small' commercial use.

Most of the safes which presently offer a considerable degree of security are those generally intended for commercial or industrial use, costing upwards of $5,000 or so, and thus are unlikely to attract buyers requiring them for such purely domestic purposes as the protection of small personal valuables, stamp and coin collections, documents and the like. Apart from relying upon such risky expedients as the simple concealment, or hiding, of valuables, householders seeking small and inexpensive safes have hitherto been obliged to use those of conventional construction, most usually in the form of a segmented, fabricated box embedded, say, in a wall or floor, and having a conventional hinged door, the hinge-pins of which are accommodated in recesses near the edges of the respective top and bottom plates of the box. The only concession to security against attacks upon such safes has usually resided in some suitable restraint bar fixed internally near the door hinge to resist hammer-blows or the like upon the door, imparted with the object of knocking out the hinge-pins. Nevertheless, such a blow is usually sufficient to broach the safe since the door thereof, which is usually of only about $\frac{3}{8}''$ thickness, is necessarily too thin to adequately support the pins at a sufficient distance from its edges, thus leaving only approximately 1/16" of the door's thickness to actively resist the blow: Although this defect is to some extent corrected by locating, say, a $\frac{1}{2}''$ thick piece of angle iron to form said restraint, so that the door cannot be driven very far inwards, nonetheless the situation is aggravated because in order to be able to rotate the door on its hinges it is customary to weaken it still further by cutting away a small portion of its rear edge for clearance purposes. Also, a long 'jimmy' or a similar instrument can usually be inserted into the gap near the 'lock side' of the safe door, and such a jimmy may be given a blow with a hammer which will usually suffice to distort the structure in order to facilitate a further jimmy attack on the door.

Of course, highly sophisticated methods of safe-breaking are extant, but research has shown that a professional safe-cracker 'working' dwelling-houses will typically spend a scant 4 to 5 minutes in trying to broach a safe. Thus, a simple wall or floor safe can be successfully opened by the wrongdoer in such a break-in.

It is therefore an object of the present invention to provide an improved construction of small safes to thereby safeguard such against unlawful entry by all but the most determined safe-breaker.

According to the present invention, therefore, in a first aspect thereof, a safe comprises a body defining a chamber, and a door therefor; characterised in that the sidewalls of said body are formed from a single sheet of mild steel roll-formed and welded into tubular configuration, the rear wall of said body being a mild steel plate welded into place; whereby there is provided a substantially unitary construction of said body having rounded corners—to be hereinafter referred to—or being of circular cross-section.

In a second aspect thereof, the present invention may consist in a safe comprising a body defining a chamber, and a door therefor; hinge means on the inside face of said door, and slide means, associated with said hinge means, to permit limited movement of the said door to and away from said body; a plurality of registering pegs projecting from the inside face of said door; a co-operating plurality of registering tubes mounted upon the inside faces of the sidewalls of said body, each registering peg being receivable within a respective one of said co-operating registering tubes; and locking means for the said safe.

Preferably, there may be a plurality of hardened steel dowels randomly embedded in the door, particularly in front of the lock tongue, the longitudinal axes of these dowels lying in the plane of the door. Such dowels will ideally be of, say, 50 to 80 Rockwell hardness.

Figure 2:
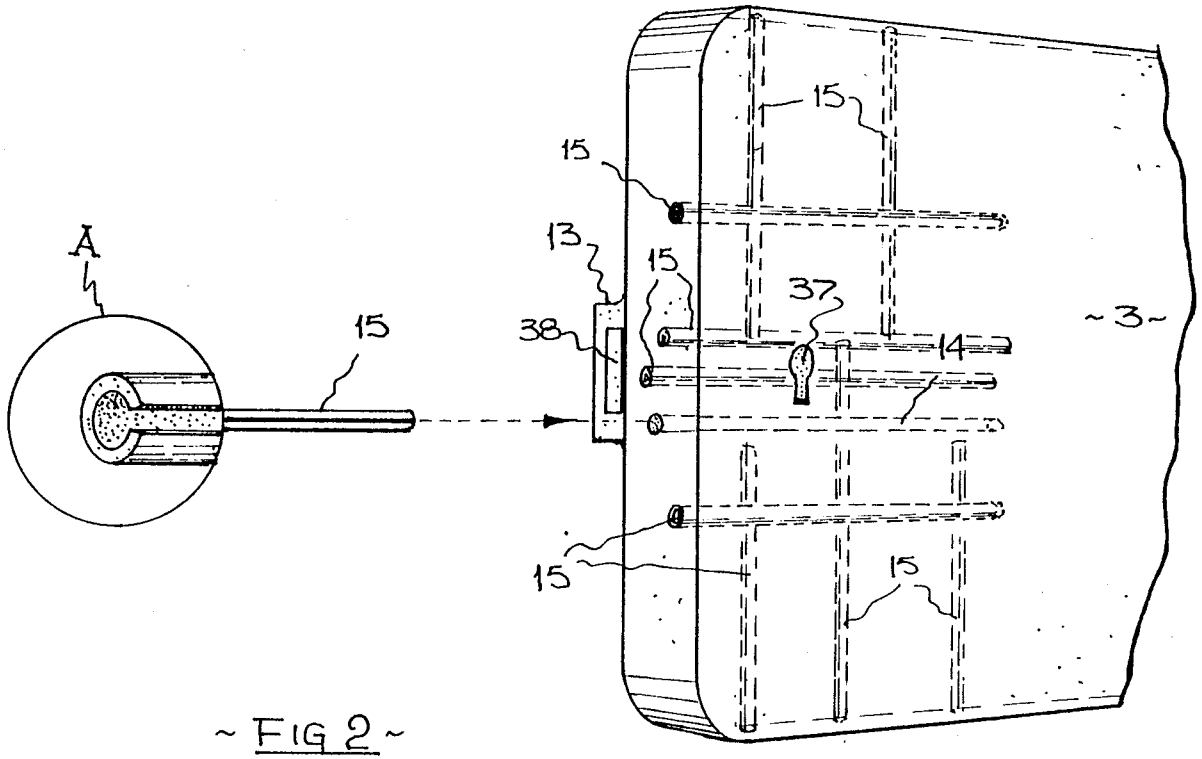

In order that the reader may gain a better understanding of the present invention, a preferred embodiment thereof will hereinafter be described, by way of example only, and with reference to the accompanying drawings in which:

FIG. 1 is a perspective view of an inventive safe with its door removed for clarity; and FIG. 2 is a fragmentary view of a safe door, showing the configuration of its associated steel dowels.

In FIG. 1 there is to be seen a safe, generally referenced 1, and consisting of a body 2 defining a chamber and a door 3 therefor. Safe body 2 has its sidewalls 4, 5, 6 and 7 formed from a single sheet of such material as mild steel roll-formed and resistance-welded into place. Mild steel rectangular hollow-section stock complying with Australian Standard No. 1163 is highly suitable, and the body may be of any size but would typically be sufficient to form a safe having frontal dimensions of, say, approximately 12"×12".

After the RHS stock has been roll-formed and welded, the resulting tube is cut to length in known manner. A safe body made as described above provides a substantially unitary construction having rounded 'corners' 9, 10, 11 and 12, which corners impart to the body a rigidity far greater than that offered by conventional safe construction in which five flat plates are welded together to form the body of the safe.

The locking mechanism of any safe tends to present a weak point and it is the practice to insert a hardened—but not tempered—steel plate between the inner surface of the door and the lock casing 13. Alternatively, a conventional wafered door may be provided, such a wafered door perhaps having a 'wear-plate' of 11–14% manganese steel which work-hardens when attacked. Whatever door construction is employed, the aim is to provide a protective region which is harder than the steel used in the manufacture of drill bits. It has been proposed to harden safe doors and/or safe bodies as, for example, by immersion in a suitable cyanide bath, but in practice the use of such treated steel has proved to be too costly.

According to the present invention, and with particular reference to FIG. 2, a plurality of bores, such as 14, is randomly drilled into the door 3, in the plane of the door as shown. Into each of these bores, ideally of $\frac{1}{8}''$ diameter, is hammered a hardened steel dowel 15. Each dowel 15 is of C-shaped cross-section, best to be seen in the inset 'A', and is of the kind termed a "SEL-LOCK" spring pin. The external diameter when at rest should be $\frac{1}{8}''$ and the length up to, say, 2"; the Rockwell hardness of such steel dowels is preferably in the range 50 to 80, and ideally between 60 and 70. The hardened steel dowels are hammered into respective bores in the door and punched flush with, or slightly below, the surface of the door edge. These embedded dowels, the positions of which are not visible externally, will act to resist any attempt to drill the lock out.

Referring again to FIG. 1, suitable fixing holes such as 16 may be provided in the sidewalls and/or the rear wall of safe body 2 as desired in order to facilitate the installation of the safe within some other structure such as a wall or a floor, or even in a car or truck. Thus, in the case of a brick wall for example, suitable bolts may be threaded through the holes in the safe so as to protrude outwardly into a gap in a course of bricks. When the safe is positioned within the gap, the bolts are thus inaccesible excepting to a person authorised to open the safe. In this connection, fastenings of the kind which spread upon insertion are preferably applied via the various fixing apertures from inside the safe during the installation procedure. For example, when embedding the safe in a concrete or timber floor, suitable protrusions from said safe may be located in a manner which would subsequently require a least the partial destruction of the floor in order to remove the safe therefrom. However, in any such installation, the strength or impregnability of the safe is in no way dependent upon the strength of the supporting structure per se.

While the safe according to the present invention has been described and illustrated as having a round-cornered body of substantially rectangular cross-section, a safe body of other cross-section—such as circular—is nevertheless also contemplated. Locks may be of any suitable kind, such as combination of six-lever key-operated; and ideally all welds are electric-arc welds.

In FIG. 1 there is shown a safe door 3 which is capable of limited movement to and away from safe body 2. Although door 3 is shown as being removed from body 2 for the sake of clarity, in fact it is anchored to the body 2 as will be hereinafter described. The door 3 is capable of a degree of sliding motion with respect to body 2 by virtue of at least two slide rods such as 17 and 18 which slidingly extend through the respective slide channels 19 and 20 which are electrically arc-welded to a sidewall, such as that referenced 7, of safe body 2. These slide rods or bars 17 and 18, and associated slide channels 19 and 20 may be of any suitable cross-section and, more particularly in safes of larger size, may well operate on roller bearings or the like. Slide rod 17 is provided with a rear detent pin 21, while slide rod 18 has a similar rear detent pin 23. Door 3 is journalled between the front end of slide rods 17 and 18 via a hinge means, the hinge block 24 of which is electrically arc-welded to the inside of the door as illustrated. Mounted atop hinge block 24 is a stop block 25 having threaded through it a limit screw 26. By varying the distance by which this screw protrudes beyond the rear face of one or more stop blocks such as 25, the angle between the door and the sides may be prevented from becoming less than 90° when door 3 is closed. When the correct distance has been attained, limit screw 26 is immobilized by the locknut 27.

Door 3 is provided with a plurality of registering pegs 28, 29, 30 and 31 which project from its inside face and are arranged to be received in respective co-operating registering tubes 32, 33 34 and 35 each of which is electrically arc-welded into a respective corner of the chamber defined by body 2. Each of the registering pegs is a press-fit through door 3 and is maintained in place by means of a "SEL-LOCK" dowel, as those referenced 36 and 37.

With the safe initially open, the door is closed by firstly pulling the door outwards, the slide rods 17 and 18 sliding through their associated slide channels 19 and 20 until halted by the detent pins 21 and 23. Door 3 is then rotated about the hinge-pins of the hinge means into a position wherein the pegs 28, 29, 30 and 31 may accurately approach the open mouths of the co-operating registering tubes 32, 33, 34 and 35. The door is swung about so that the pegs are finally in register with their associated tubes, and the door may then be pushed towards the body until the pegs ride home in their tubes to a position determined substantially by the eventual abutment of the inside surface of the door 3 against the stops or anti-tamper bars 36, 37 and 38 which are in turn electrically arc-welded to the interior surfaces of the sidewalls 4, 5 and 6 respectively of body 2. The lock 13 is then used in the usual manner to lock the safe.

In this closed position the periphery of door 3 lies with a neat fit within the front aperture of body 2 so that the front face of the closed safe is substantially flush.

To open the door 3, the above-described procedure is reversed after unlocking lock 13. That is to say, a suitable externally-mounted handle, aligned with the centre-line of rods 17 and 18, may be grasped and the door pulled outwards away from body 2 by initially sliding the slide bars 17 and 18 partly out of their co-acting slide channels 19 and 20 until the two rear detents 21 and 23 engage the back ends of the slide channels 19 and 20. The registering pegs 28, 29, 30 and 31, having by now been retracted from their respective registering tubes 32, 33, 34 and 35, permit door 3 to be rotated about its hinge-pins to the open position once again. As the reader will realize, the length of the registering pegs should be arranged to be just less than what may be termed the 'stroke' of the slide rods as they travel through the slide channels.

It will furthermore be noticed that the stops or anti-tamper bars 36, 37 and 38 are located some small distance back—about ½" for preference—from the front face of body 2, not only to locate the closed door in a flush position relative to the body but also to resist the insertion of any tool or instrument through the very narrow gap between the door and the body.

It will be appreciated that a safe constructed in accordance with the above description is extremely strong and to a large extent tamper-resistant. The hinge means is hidden wholly within the safe and there is no access thereto when the safe is closed; in fact, an observer of the closed safe would have no way of knowing along which edge the hinge might be located. The door is arranged to fit so neatly within the front aperture of the body that no tool or instrument of any 'useful' size could be inserted in the resulting gap and, even if such were, it could not be pushed beyond the stops or anti-tamper bars. In any case, it would be unlikely to be as strong as the tongue 39 of the lock mechanism 13. Furthermore, the integrity of the door 3 does not depend upon the strength of the hinge, as is usually the case with conventional safes, but rather on the registering pegs which fit into their co-acting tubes with a small clearance. These registering pegs are made from mild steel stock and consequently a person attempting to broach the safe by dealing it a blow or blows with such means as a sledge-hammer would merely succeed in urging the pegs even more firmly into their tubes. Being made of mild steel, the pegs may bend or become squashed—and so jam into the tubes—but will not break off, so leaving the door substantially undisturbed. There again, by virtue of the very small clearance between door and body, any oxy-acetylene torch attack will tend to jam the door more firmly in the opening.

The only other region susceptible to attack would be the rear wall and, as has been discussed previously herein, the weld therein is not accessible. Thus the only course open to a thief would be to rip the safe from the wall or attempt to demolish the wall, and such activity is extremely unlikely to be attractive to a person knowing that the safe is a domestic fitting likely to contain only small valuables.

In a variation, the safe according to the present invention may be provided with a false rear wall 40 adapted to fit between true rear wall 8 and the detent pins 21 and 23 of slide rods 17 and 18 when the door is closed. This false rear wall is a mild steel plate substantially identical with the true rear wall plate 8 and conceals an inner door to a second compartment at the back of the chamber. This inner door is hinged to the safe body via hardened steel dowels and, as in the case of the main door, has anti-tamper bars behind it; a conventional lock is fitted. In order to better conceal the fact that the false rear wall is not the true one, its outwardly-facing surface may be flock-coated. Such a flocked finish, standing very slightly proud from the metal surface as it does, and being compressible to a small degree, will be found to effectively conceal the gaps between the edges of the flocked plate and the sidewalls of the safe body, and thus the existence of the inner door to the hidden rear compartment will not be suspected. The flock-coated steel false rear wall is able to be removed from the chamber by the use of a magnet, so exposing the hidden inner door.

It will therefore be seen that the present invention provides, at low cost, a small safe with unusual strength and integrity, predominantly as a consequence of its single-piece tubular body section which eliminates the need for four corner-welded seams.

In its preferred embodiment, the invention not only provides a low cost safe, the strength of which does not depend upon the strength of its door hinge, but also results in a structure which will defeat ordinary attempts to penetrate it with all but the most destructive means, such as, say, gelignite, since when closed it not only conceals the nature and location of its vital components, but also it is designed to resist the admission of any tools which would be large enough to have invasive effect. Finally, even if stolen and totally removed by partially destroying a building which housed it, it would still be difficult to broach since its peculiarly rugged construction would defeat even such extreme measures as placing it in a press in order to attempt to rupture it by shear forces.

The claims defining the invention are as follows.

I claim:

1. A safe comprising a body defining a chamber and a door therefor, sidewalls of said body being formed from a sheet of mild steel roll-formed and welding into tubular configuration, a rear wall of said body being a mild steel plate welded into place to thereby provide a substantially unitary construction of the said body, having rounded corners; an elongated block secured to the inside face of said door; at least two slide bars the ends of which are pivotally affixed to said elongated block and which slidingly extend through co-operating bores in associated slide channels on the inside of said body, the elongated block carrying a stop means to limit the inward movement of the door when closed and detents on the free ends of said slide bars permitting limited movement of the said door to and away from said body; a plurality of mild steel registering pegs projecting perpendicularly from the said inside face of said door; a co-operating plurality of registering tubes on the inside of the sidewalls of said body, each registering peg being receivable within a respective one of said co-operating registering tubes so that the front face of the safe when closed is flush; and a locking mechanism for the door.

2. The safe as claimed in claim 1, wherein a plurality of hardened steel dowels, each having a Rockwell hardness of between 50 and 80, is randomly embedded in said door, the longitudinal axes of said dowels lying in the plane of said door.

3. The safe as claimed in claim 1, wherein the safe has, within said chamber, an inner compartment remote from said door and concealed by a false rear wall constituted by a mild steel plate substantially identical to the said rear wall.

4. A safe comprising a body defining a chamber and a door therefor; sidewalls of said body being formed from a sheet of mild steel roll-formed and welded into tubular configuration; a rear wall of said body being a mild steel plate welded into place to thereby provide a substantially unitary construction of the said body, having rounded corners; an elongated block secured to the inside face of said door; a pair of slide bars the ends of which are pivotally affixed to said elongated block and which slidingly extend through co-operating bores in associated slide channels on the inside of sidewalls of said body, the elongated block carrying a stop means to limit the inward movement of the door when closed and detents on the free ends of said slide bars permitting limited movement of the said door to and away from said body; a plurality of hardened steel dowels, each having a Rockwell hardness of between 50 and 80, randomly embedded in said door, the longitudinal axes of said dowels lying in the plane of said door; a plurality of mild steel registering pegs projecting perpendicularly from the inside face of said door, a co-operating plurality of registering tubes on the inside of the sidewalls of said body, each registering peg being receivable within a respective one of said co-operating registering tubes so that the front face of the safe when closed is flush; an inner compartment within said chamber, remote from said door, and concealed by a false rear wall constituted by a mild steel plate substantially identical to said rear wall.

* * * * *